United States Patent [19]

Stevens

[11] 4,231,378

[45] Nov. 4, 1980

[54] DEVICE FOR PERFORATING PACKAGED CIGARETTES

[76] Inventor: Pierre M. Stevens, 7 Stone Arch Dr., Old Westbury, N.Y. 11568

[21] Appl. No.: 904,792

[22] Filed: May 11, 1978

[51] Int. Cl.[3] ..... A24F 13/00

[52] U.S. Cl. ..... 131/170 R; 206/236; 30/358; 131/253

[58] Field of Search ..... 131/253, 252, 170 R, 131/83, 188, 233, 250; 206/86, 236, 238; 144/2 J, 2 K, 30; 30/358, 360

[56] References Cited

U.S. PATENT DOCUMENTS

| | | | |
|---|---|---|---|
| 2,333,049 | 10/1943 | Shapiro | 131/170 R |
| 4,054,146 | 10/1977 | Ortiz, Jr. | 131/170 R |
| 4,120,309 | 10/1978 | Brantl et al. | 131/170 R |

*Primary Examiner*—Stephen C. Pellegrino
*Attorney, Agent, or Firm*—Frishauf, Holtz, Goodman & Woodward

[57] ABSTRACT

A device for perforating packaged cigarettes comprising first and second housing members, one of which is movably received within the other, one of the housing members having a plurality of spaced pins or needles which are movable to perforate or pierce the cigarettes contained within a package. The device includes means for selectively raising and lowering the package of cigarettes so as to create perforations at different points along the lengths of the cigarettes. Optionally provided is a locking mechanism for preventing relative movement of the housing portions to prevent the needles from inadvertently protruding from a nested position, thereby increasing the safety of the device.

30 Claims, 23 Drawing Figures

DEVICE FOR PERFORATING PACKAGED CIGARETTES

BACKGROUND OF THE INVENTION

This invention relates to a device for perforating packaged cigarettes, or the like.

It is generally known that perforating cigarettes reduces the toxicity of the smoke inhaled by the smoker. Individual cigarette-perforating devices are disclosed, for example, in U.S. Pat. Nos. 2,854,010 to Stamm; 3,158,157 to Risk; and 3,405,718 to Grassi. The devices illustrated in these prior patents are for perforating single cigarettes after they are removed from the package, and are therefore inconvenient.

The object of the present invention is to provide an improved device for perforating a complete package of cigarettes in an efficient manner, the device being suitable also for use in providing multi-perforations in the individual cigarettes in the pack at different stages of use.

It is a further object of the invention to provide an improved device for perforating a package of cigarettes at different points along the length of the cigarette, in a simple, accurate and reliable manner.

SUMMARY OF THE INVENTION

According to the present invention, a device for perforating packaged cigarettes, or the like, comprises a first housing member at least partially defining a receiving area for a package of cigarettes, or the like and piercing means coupled to the first housing member and carrying a plurality of piercing needles, the piercing needles being movable relative to the first housing member to cause the piercing needles to pierce the cigarettes in the cigarette package which is located in the receiving area. The first housing member comprises needle receiving openings through which the piercing needles pass for guiding the piercing needles during the piercing of the cigarettes.

According to a first preferred arrangement, locking means is coupled to at least one of the first housing member and piercing means for locking the first housing member and piercing means relative to each other so that they are substantially immovable relative to each other, thereby preventing the piercing needles from passing through the needle openings.

According to a further feature of the invention, means is provided for selectively entering the receiving area for selectively raising a package of cigarettes in the receiving area. The entering means may be separate from the locking means, or combined therewith.

According to a further feature of the invention, at least some of the plurality of piercing needles having different lengths so that the cigarettes are successively pierced, thereby reducing the amount of force required by the operator during piercing of a package of cigarettes. The variable sized piercing needles may be implemented with or without the locking means and/or the means for entering into the receiving area for selectively raising the package of cigarettes.

In a preferred arrangement, the device comprises at least two nested housing members which are slideable relative to each other and which are spring biassed in such a direction that the needles are maintained out of the receiving area in the normal inoperative condition of the device. The housing members are moved relative to each other by the operator, against the bias of the spring members, to cause the piercing needles to enter the receiving area to pierce the cigarettes in the package.

DETAILED DESCRIPTION

Figure 1:
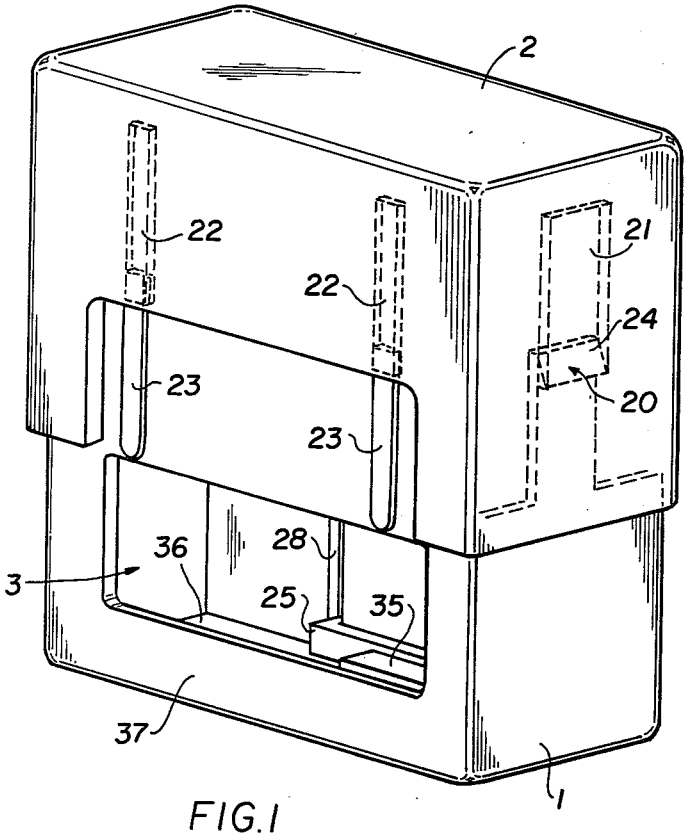
FIG. 1 is a perspective view of a device of the present invention.
Figure 3:
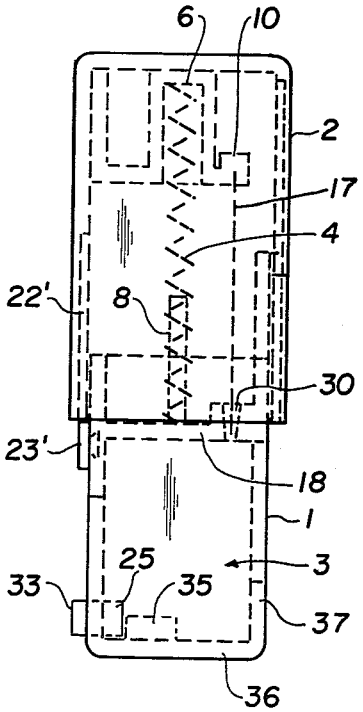
FIG. 3 is a left side view of the device of FIG. 1.
Figure 2:
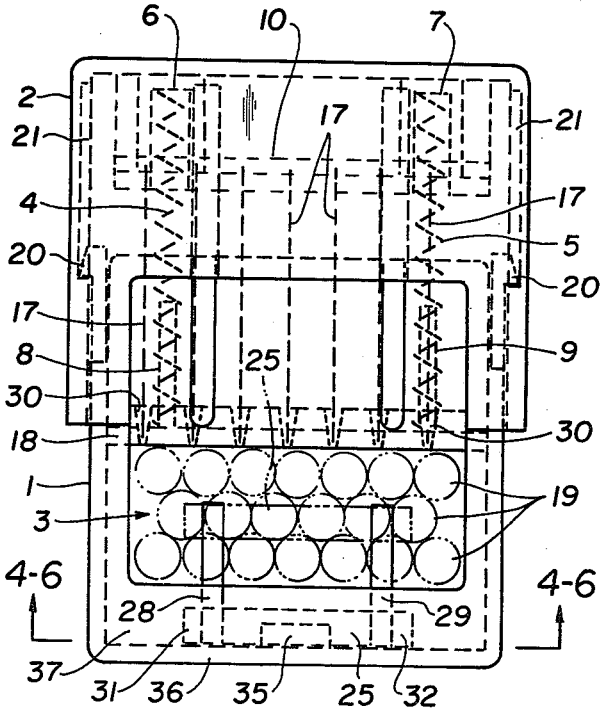
FIG. 2 is a front view of the device of FIG. 1, also showing features of the internal construction thereof.

Referring to FIGS. 1–3, the cigarette perforating device of the present invention comprises an inner housing member 1 and an outer housing member 2 which is slidable relative to the inner housing 1. The housing 1 has a generally rectangular receiving area 3 which is dimensioned to receive a package of cigarettes therein. The receiving area 3 is dimensioned so as to accept all of the presently available sizes of cigarette packages. Two coil springs 4, 5 are mounted internally of the housing members 1 and 2 so as to bias the housings 1 and 2 apart from each other in the position shown in FIGS. 1–3. The springs 4, 5 are received in receptacles 6, 7 in housing 2, and are mounted around posts 8, 9 attached to housing 1.

Housing 2 further has a support or partition member 10 which has elongated piercing needles 11–17 fixedly mounted thereto. The partition member 10 may, for example, be a plastic member with the ends of the needles 11–17 embedded therein. The needles 11–17 further extend partially into a partition member 18 which forms part of the housing 1. See FIGS. 2 and 3. When the housings 1 and 2 are in their fully open position, the pointed ends of the needles are received in corresponding holes 30 in partition 18. As the housings are squeezed together, for example by finger pressure, the needles are caused to protrude from the holes in partition 18 and to extend into the space defined by receiving area 3 so as to puncture all of the cigarettes in the package which is placed in receiving area 3.

The needles 11–17 are spaced substantially equidistant from each other. For conventional cigarette packages used in the United States, seven needles are required. By orienting the needles as illustrated in FIG. 2, when the needles puncture adjacent cigarettes, the cigarettes will have rotational forces imparted thereto which are counteracting each other. The arrangement of the needles as shown in FIG. 2 will tend to keep the cigarettes in position during the puncturing process and will therefore promote more uniform puncturing of the cigarettes in the package. The needles are also arranged to puncture cigarettes off-center, as seen in FIG. 2. Thus, when the position of the pack in the receiving area is reversed, different portions of the cigarette will be pierced, thereby permitting accurate double piercing for improved reduction of toxicity. The feature of reducing rotation of cigarettes is particularly important when the cigarettes are punctured twice, for example once by having the package arranged in the receiving area 3 in a first orientation, and a second time by reversing the orientation of the package in receiving area 3.

As seen in FIGS. 1 and 2, the upper portion of housing 1 has a projection 20 extending therefrom and the side portion of housing portion 2 has a slot or channel 21 therein. The slot or channel 21 is preferably molded into the side of housing 2. A similar arrangement is provided on the opposite side of the device. The projections 20 are guided in the respective slots 21 and act as a stop-member to prevent the springs 4, 5 from causing the housings 1, 2 to completely separate from each other. During assembly of the device, the housings 1, 2 are merely pushed together and the projection causes the sides of the housing 2 to flex outwardly to permit the projections 20 to snap into their respective channels 21. The outwardly directed faces 24 of projections 20 are inclined to facilitate initial assembly of housings 1 and 2.

Housing 1 also has guide bars 23, preferably molded thereon, which are engaged in corresponding molded-in slots 22 which receive the guides 23. The slot and guide arrangements help more accurately guide the members 1 and 2 when they are being squeezed together, for example by hand pressure, and prevent the housing 2 from binding during its movement relative to housing 1. Guides similar to guides 23 and corresponding slots similar to slots 22 may be provided on the opposite or rear surface of the housings 1 and 2 in addition to or in place of the guides and slots shown in FIG. 1.

The housings 1 and 2 are preferably made of molded plastic. The partition 18 in housing 1 is preferably molded integrally therewith, as are the spring posts 8 and 9. The support or partition member 10 and receptacles 6, 7 are preferably molded integrally with housing 2.

In use of the device of FIGS. 1–3, a pack of cigarettes is first located in receiving area 3. In FIG. 2, the cigarettes 19 are shown as they are arranged in a pack, the outer package being omitted for the sake of clarity. The housings are then pressed together by means of, for example, finger pressure. During pressure together of the housings, the pins 11–17 are caused to extend through openings 30 in partition 18 to pierce all of the cigarettes 19 in the pack. This effectively puts two holes in each cigarette, the holes being preferably made off-center of the cigarette. During later stages of use when it is desired to increase the number of holes in the cigarette, the pack is inserted a second time in a reversed position so that the cigarettes are all perforated on the opposite side portions thereof. During still further stages of use, it is desired to further perforate the cigarettes at multiple points along their length. This is accomplished in the present invention in a convenient and accurate manner by means of, for example, arrangements illustrated generally in FIG. 2 and more specifically in FIGS. 4–6.

Figure 4:
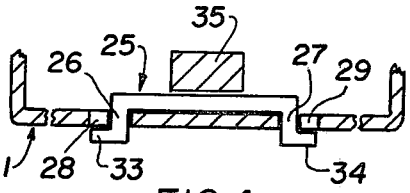
FIGS. 4–6 are partial sectional views of respective mechanisms for changing the position of perforations along the length of the cigarette.

Referring to FIG. 4, a generally U-shaped member 25 has it legs 26, 27 extending through respective openings 28, 29 in the bottom surface of housing 1. The openings or slots 28, 29 have enlarged portions 31, 32, respectively, through which the extending leg portions 33, 34 of legs 26, 27 are inserted to install the member 25 into the housing 1. The housing 1 has a stop member 35 at the end wall thereof. The stop member may be dimensioned so that the member 25 can flexibly snap into the housing 1, or may be installed after installation of the member 25 in the housing 1. In use, the member 25 may be slid from a rear position adjacent the end wall 36 of housing 1 to a forward position as shown in chain lines in FIG. 2. In the forward position, the member 25 will be located under a pack of cigarettes received in receiving area 3 so as to raise the pack of cigarettes so that the needles 11–17 will puncture the cigarettes at a different point along the lengths of the cigarettes than if the member 25 was not present. The thickness of the member 25, as seen in FIG. 4, determines the spacing between the holes made in the cigarettes along the lengths thereof. The enlarged or flanged portions 33, 34 of U-shaped member 25 may protrude out of the back of the housing 1 (FIG. 3) so as to serve as operating members for the user to grip to slide the member 25 from its inoperative (rear) position adjacent the stop member 35 to its operative (forward) position as shown in chain lines in FIG. 2. In the inoperative position, the member 25 is located under the front portion 37 of housing 1, out of registration with the receiving area 3.

Figure 5:
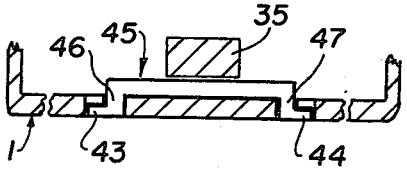

FIG. 5 illustrates a modified arrangement wherein the spacing member 45 has shorter legs 46, 47 which are dimensioned such that the enlarged or flanged portions 43, 44 are flush or slightly recessed in the rear of the housing 1. The rear surface of housing 1 has appropriately dimensioned and configured slots to receive the modified member 45.

Figure 6:
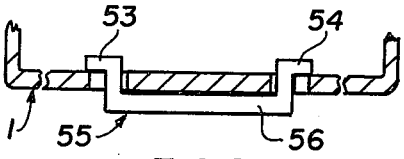

FIG. 6 illustrates a further modification wherein the spacing member 55 is mounted in reversed relation relative to the spacers 25 and 45 of FIGS. 4 and 5, respectively. The arrangement of FIG. 6 operates essentially similarly to that of FIG. 4 except that the enlarged or flanged portions 53, 54 serve as the spacing members and the cross member 56 serves as a convenient operating member for the operator to slide the member 55 between its operative and inoperative positions. Stops similar to stop 35 may be located behind flanged portions 53, 54.

Figure 7:
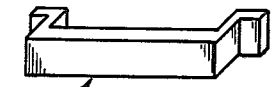
FIG. 7 is a perspective view of one of the components shown in FIGS. 4–6.

FIG. 7 illustrates a perspective view of the member 55 of FIG. 6. The members 25 and 45 of FIGS. 4 and 5, respectively, are essentially similar, but are reversed in orientation.

When the spacer member 25, or its equivalent, is in its operative position, the cigarette pack may be punctured two more times, once in its first position and a second time in its reversed position, so that the total number of holes or perforations made in each cigarette can be eight.

Figure 8:
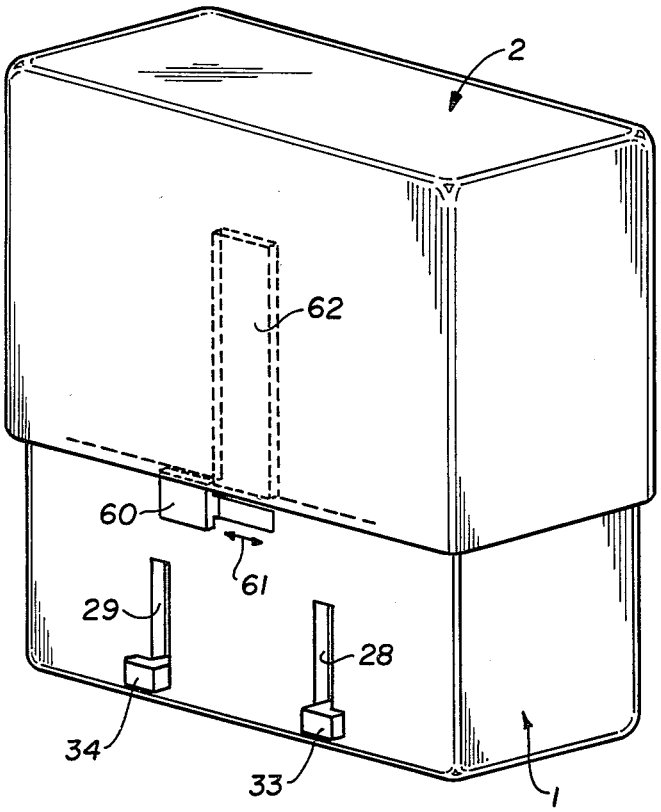
FIG. 8 is a rear perspective view of the device of the present invention showing a safety lock-out mechanism.

FIG. 8 illustrates a rear view of the invention further incorporating a safety lock-out device to help prevent inadvertent squeezing together of the housing members to expose the needles 11–17. The safety lock-out device includes a slidable member 60 which is slidable in the direction of the arrow 61. The member 60 is preferably slidably mounted to housing portion 1. Housing 2 has a slot or channel 62 formed therein which is slightly wider than the width of slidable member 60. When slidable member 60 is in the position shown in FIG. 8, the housings 1 and 2 cannot be moved relative to each other. When slidable member 60 is slid to a position in registration with slot or channel 62, the housings 1 and 2 may be compressed relative to each other, the member 60 being slidable within the channel 62. The member 60 may be spring biased out of registration with channel 62.

Figure 9:
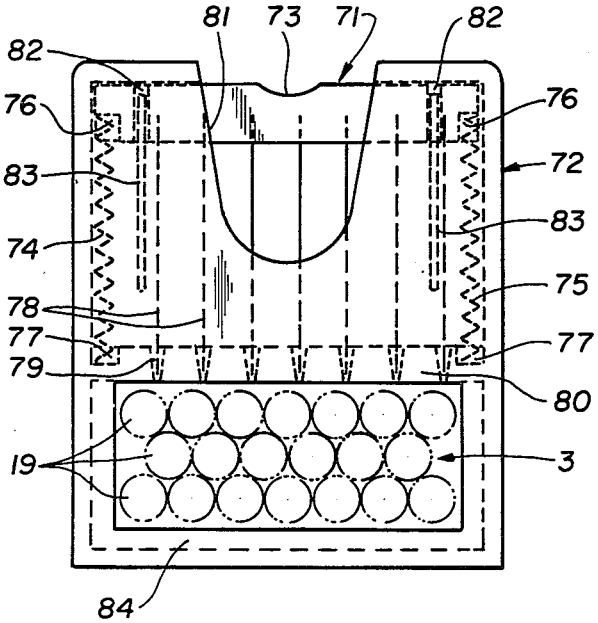
FIG. 9 is a front view of a modified embodiment of the present invention.
Figure 10:
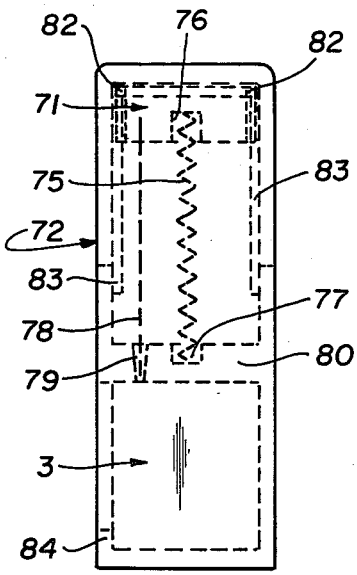
FIG. 10 is a right side view of the device of FIG. 9.

FIGS. 9 and 10 illustrate front and right-side views of a further embodiment of the invention which comprises an outer housing 72 containing therein a transverse member 71 which is slidable within housing 72. The member 71 has an indentation 73 therein against which a finger of the user of the device rests. Springs 74, 75 are provided to bias the member 73 in the position shown in FIG. 9. Springs 74, 75 are received in recesses 76, 77 in member 73 and housing 72, respectively. Posts, similar to the posts 8 and 9 in FIG. 2 can be provided to extend within the springs 74, 75 to add stability to the springs.

A plurality of piercing pins or needles 78 are embedded in the cross-member 71, which is preferably made of a plastic material, and extend into openings 79 in a cross member 80 of housing 72. The housing 72, with cross member 80, is preferably made of molded plastic material. The housing 1 has an opening defining a cigarette package receiving area 3 and has a further opening 81 formed therein to permit an operator to grasp the device with the hand and move the cross-member 73 downward in FIG. 9 toward the cigarettes 19 in order to pierce the cigarettes 19 with the needles 78. In order to improve the stability and operation of cross member 73 when being pressed toward the cigarette package in receiving area 3, slots 82 may be formed in the upper and/or lower surfaces of cross member 71 and guide bars may be formed in the upper and/or lower inner surfaces of housing 72 so as to be received in the slots 82. Alternatively, the slots may be provided in the inner surfaces of housing 72, and mating projections may be formed in member 71. The slots and projections are preferably molded into the plastic material from which the members 71 and 72 are molded. If desired, member 71 may have front and rear panels extending therefrom in order to cover the openings 81 so that the innards of the device cannot be seen.

The embodiment of FIGS. 9 and 10 may employ a device for raising and lowering the cigarette package, similar to those devices illustrated in FIGS. 1–7. When employing such raising and lowering devices, it may be necessary to make them narrower so that they will fit under the front lip 84 of member 72 when they are in their inoperative positions. Alternatively, the housing 72 can be modified to extend the front lip 84 to receive the raising and lowering device therein when the raising and lowering device is in its inoperative state.

Figure 11:
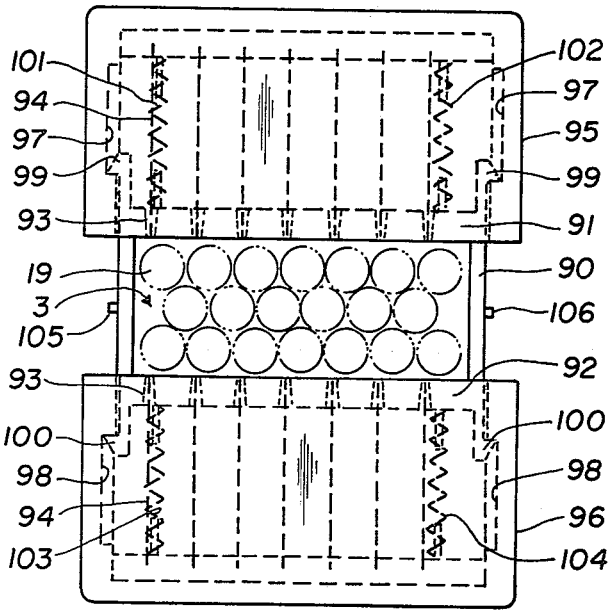
FIG. 11 is a front view of a further modified embodiment of the present invention.
Figure 12:
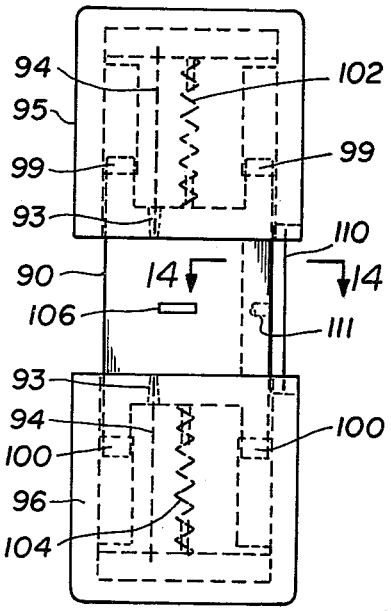
FIG. 12 is a right side view of the device of FIG. 11.
Figure 13:
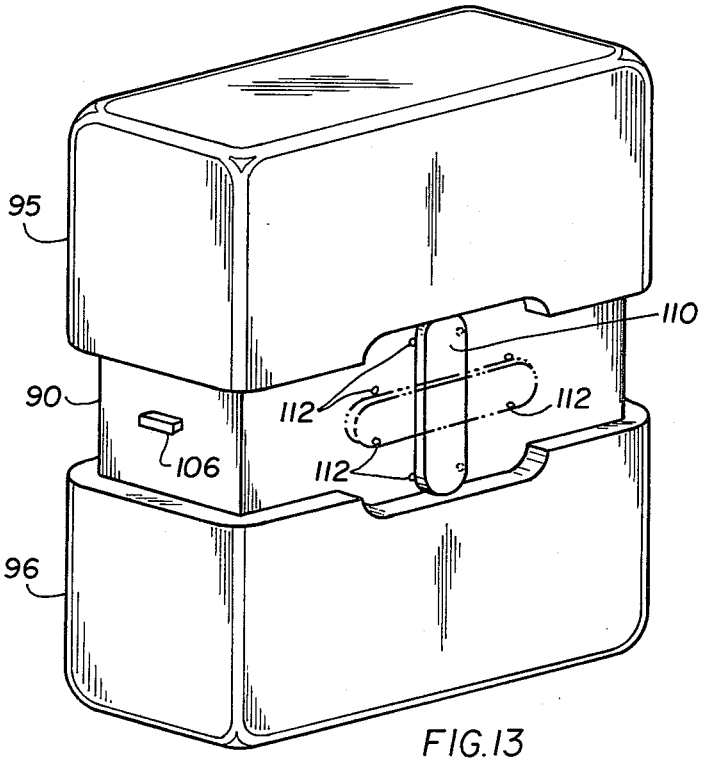
FIG. 13 is a rear perspective view of the embodiment of FIGS. 11 and 12, showing a blocking device therefor.

FIGS. 11, 12, and 13 illustrate a further embodiment according to the present invention. This embodiment comprises a central housing member 90 having transverse walls 91, 92 defining a cigarette package receiving area 3 therebetween. Walls 91, 92 have openings 93 for receiving pins or needles 94 therethrough. Outer housings 95, 96 are slideably mounted to central housing 90. The outer housings have respective sets of pins or needles 94 embedded in end surfaces thereof. Preferably, the outer housings 95, 96 are made from molded plastic and the needles are embedded therein either during manufacture of housings 95, 96, or are installed later. Outer housings 95, 96 have respective slots 97, 98 therein for slideably receiving respective engagement members 99, 100 which extend from central housing 90. Springs 101–104 are provided around respective posts of the members 90, 95 and 96 to bias the outer housings 95 and 96 away from the receiving area 3 as shown in FIGS. 11–13.

In operation, a cigarette package is inserted into receiving area 3 and the user grasps the device in the hand and squeezes outer housings 95 and 96 toward each other. This causes the pins or needles 94 to project from the respective openings 93 and to pierce the cigarettes 19. In order that the outer housings 95, 96 travel equidistantly relative to the central housing 90, stops 106 may be provided on the outer housing 90 to limit the travel of respective outer housings 95 and 96. Alternatively, the lengths of slots 97, 98 for receiving the engagement members 99, 100 may be dimensioned to abut against the ends of engagement members 99, 100 when each of the outer housings 95,96 has moved to approximately the central position of central housing 90, thereby limiting the relative travel of outer housings 95, 96 in a manner similar to the limiting effect produced by stops 105, 106.

The embodiment of FIGS. 11–13 is advantageous in that the needles 94 may be made shorter, thereby reducing the possibility that the needles would be bent during use. Also, the relative travel of each of the outer housings 95, 96 is reduced, thereby making operation of the device easier. FIG. 13 illustrates a locking device 110 for use with the embodiments of FIGS. 11–13 in order to prevent the outer housings 95, 96 from being inadvertently moved toward each other to expose the pins or needles when a pack of cigarettes is not inserted in receiving area 3. This increases the safety factor of the device, especially when a child or someone unfamiliar with its use handles same. In FIG. 12, the locking device 110 is only partially schematically shown for simplicity. The locking device is pivotally mounted to the central housing 90 by means of, for example, a shaft 111. When it is in the position shown in solid lines in FIG. 13, the housing members 95, 96 are prevented from moving relative to the central member 90. When the locking member 110 is pivoted to the position shown in chain lines in FIG. 13, the outer housings 95, 96 may be operated toward each other. It is noted that the locking device 110, in the position shown in chain lines in FIG. 13, also serves as a stop member so that housings 95, 96 will move substantially equidistantly relative to the central housing 90, thereby obviating the need for stop members 105, 106 shown in FIGS. 11 and 12. Dimples or slight projections 112 are provided in the rear surface of central housing 90 to snappingly engage the member 110 to retain it in either its locked or unlocked position, as shown in FIG. 13. Preferably, the locking member 110 is formed of plastic and is slightly flexible so that it is easily and securely retained in position by means of projections 112.

Figure 14A:
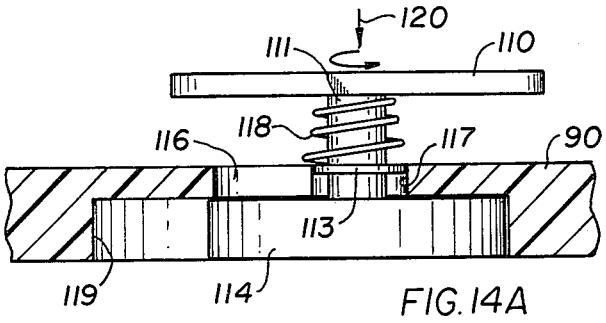
FIGS. 14A–14C show the locking device of FIG. 13 in different operational states.
Figure 14B:
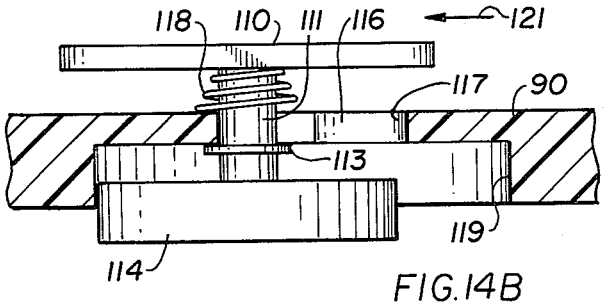
Figure 14C:
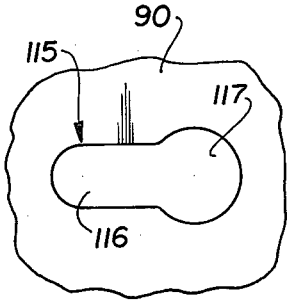

FIGS. 14A and 14B illustrate a locking device 110 which is combined with a device for raising and lowering a cigarette package in the receiving area 3. This device comprises the locking lever 110 having a shaft 111 extending therefrom. Shaft 111 further has an outwardly projecting portion 113 which may be integrally formed thereon or which may be a separate member secured thereto, such as a washer. The shaft 111 has a raising and lowering member 114 secured to the end thereof which is interior of the receiving area 3 of central housing 90. Central housing 90 has a keyhole slot 115 formed therein, as shown in FIG. 14C. The keyhole slot comprises elongated portion 116 and an enlarged portion 117. The shaft 111 is dimensioned so as to pass within both the enlarged and elongated slot portions 116 and 117, and the projecting portion 113 of shaft 111 is dimensioned so as to only fit through the enlarged portion 117 of the keyhole slot 115. A spring 118 is provided to bias the raising and lowering member 114 in a direction such that it tends to be nested within the recess 119 formed in the inner surface of central housing 90.

FIG. 14A shows the locking device in its unlocked position with the raising and lowering member 114 located in the recess 119. This is the normal or inoperative position of locking member 110. In order to raise the cigarette package so that the cigarettes are punctured at a different position along the lengths thereof, the locking element 110 is pushed in the direction of the arrow 120 (FIG. 14A) to cause the enlarged or washer portion 113 to pass through the enlarged slot portion 117. Then, the locking device is moved in the direction of the arrow 121 (FIG. 14B) to cause the enlarged shaft portion 113 to pass under the elongated keyhole slot 116. When the locking device is released, the enlarged portion 113 will not be able to pass through the keyhole slot 116 and will bear upon the inner surface of central housing 90, thereby retaining the raising and lowering member 114 in its extended or "raised" position to raise a package of cigarettes within the receiving area 113. The locking device 110 is moved to its inoperative position by reversing the above steps. Preferably, the locking member 110 is elongated as illustrated in FIG. 13 and the raising and lowering member 114 is a substantially circular disc, the recess 119 being dimensioned so as to receive member 114.

Figure 15A:
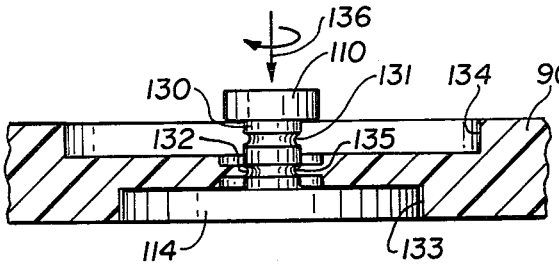
FIGS. 15A and 15B show a further device for raising and lowering a cigarette package in the receiving area of the device.
Figure 15B:
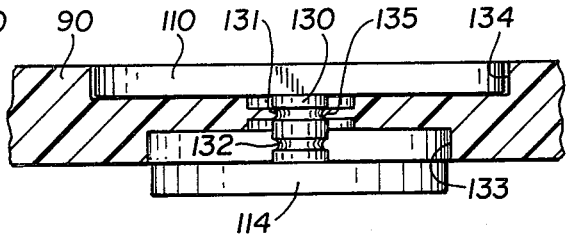

FIGS. 15A and 15B illustrate a further locking and raising and lowering arrangement according to the invention. The locking member 110 has a shaft 130 extending therefrom. The shaft 130 has recesses 131, 132 formed therein and a raising and lowering member 114 at the end of the shaft 130. Elements 110 and 114 are substantially the same as discussed above with respect to FIGS. 14A and 14B. The central housing 90 has a recess 133 in the inner portion thereof for selectively receiving element 114 and a further recess in the outer surface thereof for selectively receiving locking member 110. The housing 90 also has a circular projection 135 which snappingly engages the circular recesses 131, 132 in shaft 130. The shaft 130 and housing 90 are preferably made of plastic material to provide the appropriate resiliency for proper snapping action of the projection 135 in recesses 131, 132.

In operation, in order to lock the outer housings 95, 96, the element 110 is located in its "out" position as shown in FIG. 15A and is rotated to the position shown in solid lines in FIG. 13. In order to unlock the device, the locking member 110 is rotated to the position shown in chain lines in FIG. 13 (position shown in FIG. 15B). Then, the cigarette piercing device may be operated in the normal manner. In order to raise the package of cigarettes in receiving area 13, the locking member is pushed in the direction of the arrow 136 in FIG. 15A to cause the projection 135 to snappingly engage out of recess 132 and into recess 131, as shown in FIG. 15B. In this position, the locking member 110 is received in recess 134 and the raising and lowering member 14 projects into the receiving area 3, thereby raising a package of cigarettes. To lower the package of cigarettes, the user merely pushes the raising and lowering member 114 in the opposite direction to the arrow 136 to snappingly engage the projection 135 with the recess 132 as shown in FIG. 15A.

Preferably, the recess 134 is elongated so that the locking member 110 may only be received therein when it is in a rotational position as shown in FIG. 13. The raising and lowering member 114 is preferably circular, as is the recess 133. In the event that a recess 134 is not provided, the thicknesses of the locking member 110 and of the outer housings 95, 96 should be dimensioned such that proper locking will be achieved when the raising and lowering member 114 is in both its upper and lower positions. In such an embodiment, the shaft 130 should be lengthened so that suitable travel of the raising and lowering member 114 will be provided.

The locking, raising and lowering devices shown in FIGS. 14A–14C and in FIGS. 15A and 15B can be implemented with the embodiments shown in FIGS. 1–3 and in FIGS. 8–10. When used with the embodiments of FIGS. 1–3 and 8–10, the locking mechanism should be suitably located and dimensioned so as to suitably block relative movement between the respective body housings and to permit relative movement, depending upon the position of the locking device.

Figure 16:
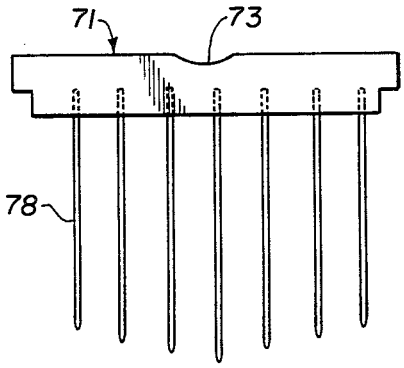
FIG. 16 illustrates a modified needle or pin arrangement in accordance with the present invention.
Figure 17:
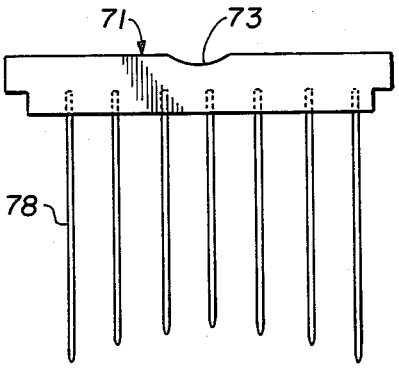
FIG. 17 illustrates a further modified needle arrangement.

FIG. 16 illustrates a modified arrangement of piercing pins or needles which is useful with all of the embodiments of the invention described herein. As shown in FIG. 16, the needles 140 are of varible length so that all of the cigarettes are not pierced at the same instant of time. This reduces the amount of force which the operator has to apply to pierce the cigarettes and renders operation of the device easier. The needles may be arranged so that the longer needles are in the central portion of the device, as shown in FIG. 16, or so that the longer needles are at the ends of the device as shown in FIG. 17. It should be clear that various other alternative arrangements of the longer and shorter needles may be provided in order to produce successive puncturing of the cigarettes. When the embodiments of FIGS. 16 and 17 is applied to the embodiment of FIGS. 11–13, each set of needles 94 which project from the outer housings 95, 96 are respectively arranged as shown in FIG. 16 or 17. The lengths of the needle receiving openings 30 in FIGS. 1–3, 79 in FIGS. 9 and 10 and 93 in FIGS. 11 and 12 are suitably long so that the variable length needles are always received in a respective needle opening to insure proper guidance of the needles during operation of the device.

Figure 18:
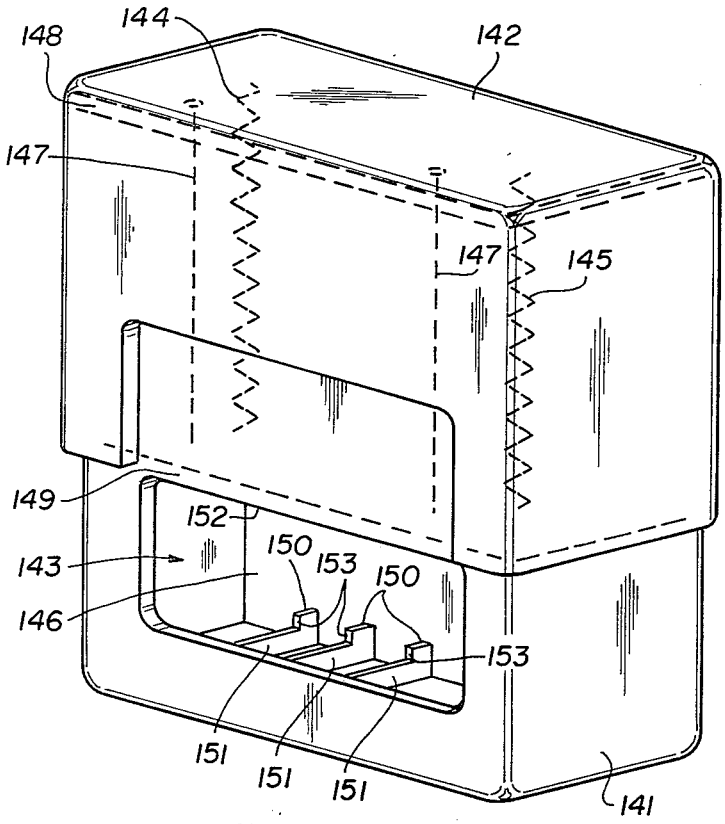
FIG. 18 is a front perspective view of a further device according to the present invention.
Figure 20:
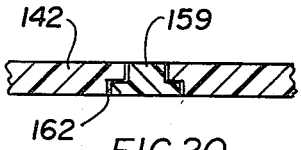
FIG. 20 is a partial sectional view showing a detail of the embodiment of FIGS. 18 and 19.
Figure 19:
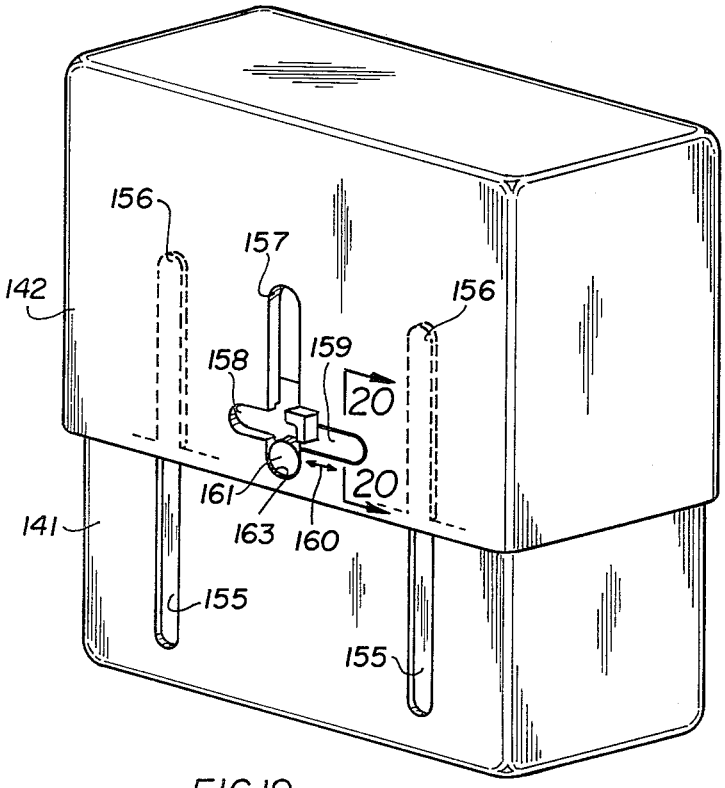
FIG. 19 is a rear perspective view of the embodiment of FIG. 18.

FIGS. 18–20 illustrate a further embodiment of the invention. Outwardly, the embodiment of FIGS. 18–20 appears similar to that of FIG. 1. The inner and outer housings 141, 142 of FIGS. 18 and 19 are biassed apart by means of springs 144, 145 which are shown only schematically for purposes of illustration. The pins or needles 147 (only two are shown in FIG. 18) are mounted in a plate-like member 148 which is maintained in position against the upper end of outer housing 142 by means of the biassing force of the springs 144, 145. The pins or needles 147 extend through apertures in the portion 149 of inner housing member 141, in a manner similar to that shown in FIGS. 2 and 3. The pins or needles may be embedded in plate-like member 148 during the molding thereof (member 148 is preferably plastic) or may be installed into pre-formed holes in member 148. Alternatively, the pins may be heated so as to pierce the plastic plate-like member 148 while being installed therein.

As seen in FIG. 18, the embodiment of FIGS. 18–20 utilizes a simplified means for raising and lowering the package of cigarettes in order to obtain perforations at different portions along the length thereof. The receiving area 143 is dimensioned so as to receive a package of cigarettes therein, the package of cigarettes contacting the bottom surface 146 and being receivable between the front surfaces 150 of spacer members 151 and the bottom surface 152 of the cross-member 149 of the lower housing member 141. When it is desired to raise the package of cigarettes, for example by about 2–3 mm, the cigarette package is lifted and tilted slightly within the receiving area 143 so that the bottom surface of the cigarette package now rests against surfaces 153 of spacer members 151. While the cigarette package is slightly tilted, it has been found that reliable puncturing of the cigarettes at a position spaced about 2–3 mm from the punctures formed when the cigarette package rests against surface 146 of receiving area 143, is still obtained. This is a simplified arrangement for raising the package of cigarettes which requires no moving parts and therefore which reduces the cost of the device and simplifies operation thereof. The spacer members 151 may be formed integral with the lower housing member 141, or may be separately formed and bonded thereto during a later stage of manufacture. Also, the number of spacer members 151 may be more or less than the three shown.

Referring to FIG. 19, a rear perspective view of the embodiment of FIG. 18 is shown. The rear perspective view illustrates recesses 155 formed in the lower housing 141 and corresponding elongated projections 156 which slideably engage in the recesses 155 to serve as guiding members during operation of the device. Further provided is a locking mechanism which not only is suitable for locking the device in its non-operative position to prevent inadvertent extension of the pins or needles when a pack of cigarettes is not installed therein, but which also provides a simplified method for retaining the device together. In this arrangement an elongated opening 157 and an elongated opening or slot 158 which crosses opening 157 perpendicularly are formed in the rear portion of upper housing 142. Slideably mounted in elongated slot 158 is a locking member 159 which is slideable in the direction of the arrow 160. A projecting member 161 is mounted to the rear surface of lower housing 141 in a manner to project therefrom and to abut against the surfaces of elongated opening 157. Projecting member 161 may be integrally molded with the rear surface of lower housing 141 or may be attached thereto later, for example by inserting same in a pre-formed opening (not shown) in the rear surface of lower housing 141. When in the position shown in FIG. 19, the apparatus is in its operable condition for piercing cigarettes. When the locking member 159 is moved to the left, the locking member will block the projecting member 161, thereby locking the device against operation.

FIG. 20 is a sectional view showing how the locking member 159 may be mounted to the upper housing 142. The undercut portion 162 of the elongated slot 158 retains the locking member 159 in position and permits sliding movement thereof. As seen in FIG. 19, since the projecting member abuts against the lower surface 163 of elongated opening 157, it also serves to prevent the upper and lower housings from being separated due to the biassing force of the springs 144, 145. This eliminates the necessity for side projections 20 and corresponding slots 21 shown, for example in FIG. 1, or the like.

While the invention has been described above with respect to specific embodiments, it should be clear that various modifications and alterations could be made thereto without departing from the scope of the invention, as claimed. For example, the various locking and devices for raising a pack of cigarettes may be modified from the specific embodiments shown, and moreover they may be used in any of the illustrated embodiments other than the ones with which they are specifically shown. Preferably, the complete device, other than the piercing needles, is made of molded plastic parts. Further, the guide slots and ribs for example slots 22 and guides 23 shown in FIG. 1 may be used with any of the other embodiments of the invention in order to improve the sliding operation of the parts relative to each other. By making the device out of plastic which is slightly yieldable, the parts of the invention may be easily assembled. The piercing needles are preferably made of stainless steel.

I claim:

1. A device for perforating packaged cigarettes, or the like, comprising:

a first housing member at least partially defining a receiving area for a package of cigarettes, or the like;

piercing means coupled to said first housing member and carrying a plurality of piercing needles, said piercing means being moveable relative to said first housing member to cause said piercing needles to pierce the cigarettes in the cigarette package;

said first housing member comprising needle receiving openings through which said piercing needles pass for guiding said piercing needles during the piercing of said cigarettes; and locking means coupled to at least one of said first housing member and piercing means for locking said first housing member and piercing means relative to each other so that they are substantially immovable relative to each other, thereby preventing said piercing needles from passing through said needle openings.

2. The device of claim 1 wherein said piercing means comprises a second housing member slideably nested with said first housing member.

3. The device of claim 2 wherein said first housing member is exterior of said second housing member.

4. The device of claim 2 wherein said second housing member is exterior of said first housing member.

5. The device of claim 1 wherein at least some of said plurality of piercing needles have different lengths.

6. The device of claim 1 further comprising means coupled to said first housing member for selectively raising a package of cigarettes in said receiving area.

7. The device of claim 1 wherein said locking means comprises means coupled to said first housing member for selectively raising a package of cigarettes in said receiving area.

8. The device of claim 1 wherein said locking means comprises a slide member slidably mounted to one of said first housing means and said piercing means, and a slot formed in the other of said first housing member and piercing means, said slide member being selectively slideable into and out of registration with said slot to permit relative movement of said first housing member and piercing means when said slot and slide member are in relative registration.

9. The device of claim 1 wherein said locking means comprises a pivotable elongated member which is pivotable to bear against at least one of said first housing member and piercing means to prevent relative movement therebetween.

10. The device of claim 1 wherein said first housing member comprises a central housing member and wherein said piercing means comprises outer housing members slideably coupled to respective opposite ends of said central housing member, each of said outer housing members carrying a plurality of said piercing needles.

11. The device of claim 10 wherein at least some of said plurality of piercing needles of each of said outer housings have different lengths.

12. The device of claim 10 wherein said locking means selectively engages both of said outer housings to prevent relative movement therebetween.

13. The device of claim 10 comprising means for biassing said outer housings away from each other and away from said receiving area.

14. The device of claim 1 further comprising biassing means for biassing said piercing means away from said receiving area to bias said receiving needles to maintain them normally out of receiving area.

15. A device for perforating packaged cigarettes, or the like, comprising:

a first housing member at least partially defining a receiving area for a package of cigarettes, or the like;

piercing means coupled to said first housing member and carrying a plurality of piercing needles, said piercing means being moveable relative to said first housing member to cause said piercing needles to pierce the cigarettes in the cigarette package;

said first housing member comprising needle receiving openings through which said piercing needles pass for guiding said piercing needles during the piercing of said cigarettes; and means coupled to said first housing member for selectively raising a package of cigarettes in said receiving area.

16. The device of claims 6 or 15 wherein said means for selectively raising comprising a raising element mounted to a surface of said first housing member which defines the bottom of said receiving area; and means for mounting said raising member to said bottom for locking said raising member in a raised position relative to said bottom.

17. The device of claim 16 wherein said locking means comprises a shaft member connected to said raising member and passing through an opening in said bottom, said shaft means having an enlarged area protruding therefrom; and wherein said opening in said bottom has a first portion through which said shaft means and enlarged portion of said shaft means may pass and a second portion in communication with said first portion through which said shaft means may pass but through which said enlarged portion is not passable.

18. The device of claim 17 wherein said bottom comprises a recess therein for receiving said raising member when it is in its lowered or inoperative position.

19. The device of claim 18 wherein said means for selectively raising further comprises spring means biassing said raising means toward its lowered position in said recess.

20. The device of claim 6 or 15 wherein said means for selectively raising comprises a raising member; a shaft coupled to said raising member and extending through an aperture in a surface of said first housing member which defines the bottom of said receiving area; said shaft having at least one recess for snappingly engaging the portion of said bottom which defines said opening; and a recess in said bottom for selectively receiving said raising member, whereby when said shaft is pushed in a direction toward the receiving area, said shaft is moved toward said receiving area until said recess snappingly engages said bottom with said raising member in a raised position in said receiving area.

21. The device of claim 15 wherein at least some of said plurality of piercing needles have different lengths such that the cigarettes are successively pierced during relative movement of said piercing means and first housing member.

22. The device of claim 6 or 15 wherein said means for selectively raising comprises at least one stepped member at least partially located in said receiving area, said stepped member having a surface raised a predetermined distance from the bottom of said receiving area for selectively abutting against the bottom surface of a package of cigarettes placed in said receiving area to thereby raise said package of cigarettes in said receiving area.

23. The device of claim 22 wherein said at least one stepped member has its stepped surface at least partially located within said receiving area located such that a package of cigarettes is locatable in said receiving area abutting against the bottom of said receiving area, and is tiltable within said receiving area to abut against the raised surface of said stepped portion of said stepped member.

24. The device of claim 22 comprising a plurality of said stepped members cooperatingly associated with said first housing member, said stepped members being spaced from each other.

25. The device of claims 1 or 6 wherein said means for selectively raising comprises a generally U-shaped member slideably mounted in a surface of said first housing member which defines the bottom of said receiving area, said U-shaped member being slideable in a direction substantially parallel to said bottom surface to selectively enter said receiving area to abut the bottom of a package of cigarettes placed in said receiving area.

26. The device of claim 25 wherein said bottom surface has a pair of slots for slideably receiving the legs of said U-shaped member, and further comprising means for locking said U-shaped member in said slot.

27. The device of claim 26 wherein said slots have enlarged opening areas for receiving the legs of said U-shaped member, said legs of said U-shaped member having flanged portions which are adapted to pass through said enlarged slot portions and which do not pass through the remainder of said slots.

28. The device of claim 1 wherein said piercing means comprises a second housing member slideably mounted relative to said first housing member, and wherein said locking means comprises a pair of elongated slot-like openings perpendicularly formed in one of said first and second housing members, said elongated slot-like openings crossing each other; a slideable member mounted in one of said slots and being slideable to block the other of said slots; and a projection member extending from the other of said first and second housing members and engageable in the other of said slot-like openings and being in interfering engagement with said locking member when said locking member blocks said other slot-like opening, thereby preventing relative movement between said first and second housing members.

29. The device of claim 28 wherein said first and second housing members are spring biassed in a direction away from each other, and said projection member abuts against a surface of said other of said slot-like openings to prevent said first and second housing members from becoming disengaged from each other due to the influence of said spring bias.

30. A device for perfortating a package of a plurality of cigarettes, or the like, comprising:

a first housing member at least partially defining a receiving area for a package of cigarettes, or the like;

piercing means coupled to said first housing member and carrying a plurality of piercing needles, said piercing means being moveable relative to said first housing member to cause said piercing needles to pierce the cigarettes in the cigarette package;

said first housing member comprising needle receiving openings through which said piercing needles pass for guiding said piercing needles during the piercing of said cigarettes; and at least some of said plurality of piercing needles have different lengths such that cigarettes are successively pierced during relative movement of said piercing means and first housing member at different relative positions of said piercing means and said first housing member, thereby facilitating piercing of said plurality of cigarettes at any given position of said piercing means relative to said first housing member.

* * * * *